US009022230B2

(12) United States Patent
Matsukura et al.

(10) Patent No.: US 9,022,230 B2
(45) Date of Patent: May 5, 2015

(54) OIL SEPARATION MEANS AND REFRIGERATION DEVICE EQUIPPED WITH THE SAME

(75) Inventors: Noriyuki Matsukura, Tokyo (JP); Tatsuru Nagai, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/639,404

(22) PCT Filed: Sep. 1, 2011

(86) PCT No.: PCT/JP2011/069879

§ 371 (c)(1),
(2), (4) Date: Oct. 4, 2012

(87) PCT Pub. No.: WO2012/043128

PCT Pub. Date: Apr. 5, 2012

(65) Prior Publication Data

US 2013/0026092 A1 Jan. 31, 2013

(30) Foreign Application Priority Data

Sep. 30, 2010 (JP) ..... 2010-222505

(51) Int. Cl.
*B04C 3/06* (2006.01)
*B04C 3/00* (2006.01)
*F25B 43/02* (2006.01)

(52) U.S. Cl.
CPC ... *B04C 3/06* (2013.01); *B04C 3/00* (2013.01); *F25B 43/02* (2013.01); *F25B 2400/02* (2013.01)

(58) Field of Classification Search
CPC ..... F25B 43/02; F25B 2400/02; B04C 3/00; B04C 3/02; B04C 2003/00; B04C 2003/006; B04C 2009/00; B04C 5/04; B04C 5/08; B04C 5/103; B04C 5/12; B04C 2005/12; B04C 2005/136; B04C 2009/005; B04C 5/107; B04C 5/13; B04C 3/06; B04C 2003/003
USPC ..... 210/512.1, 416.5, 801, 787, 788, 799, 210/304, 305; 62/470
See application file for complete search history.

(56) References Cited

U.S. PATENT DOCUMENTS 3,481,474 A * 12/1969 Paulson ..... 210/304
4,940,473 A * 7/1990 Benham ..... 96/210

(Continued)

FOREIGN PATENT DOCUMENTS

CN 1078292 A 11/1993
JP 57-127883 A 8/1982

(Continued)

OTHER PUBLICATIONS

International Search Report of PCT/JP2011/069879, mailing date Nov. 22, 2011.

(Continued)

*Primary Examiner* — David C Mellon
(74) *Attorney, Agent, or Firm* — Westerman, Hattori, Daniels & Adrian, LLP

(57) ABSTRACT

An oil separation device having an outer cylinder that extends in an axial direction; an inner cylinder that passes through the interior of the outer cylinder in the axial direction; a pair of end plates provided at both ends of the outer cylinder in the axial direction; an inlet port connected to the outer cylinder near one of the end plates and that introduces an oil-containing fluid discharged from a compressor into a space formed between the outer cylinder and the inner cylinder so as to swirl about the axis; an outlet port connected to the outer cylinder near the other end plate and that expels the fluid, from which the oil has been centrifugally separated, out of the space; and an oil discharge port, provided in the outer cylinder, for discharging the separated oil out of the space. A partition plate that extends over at least part of a cross-section perpendicular to the axial direction to partition the space in the axial direction is provided in the space.

3 Claims, 8 Drawing Sheets

(56) References Cited

U.S. PATENT DOCUMENTS

| | | | | |
|---|---|---|---|---|
| 5,024,771 | A * | 6/1991 | Chiarito | 210/791 |
| 5,053,126 | A * | 10/1991 | Krasnoff | 210/188 |
| 6,125,826 | A * | 10/2000 | Brocard et al. | 123/510 |
| 6,475,256 | B2 * | 11/2002 | Matsubara et al. | 55/337 |
| 2006/0196221 | A1 | 9/2006 | Westermeyer | |
| 2009/0095680 | A1 * | 4/2009 | Saito et al. | 210/650 |
| 2011/0294643 | A1 * | 12/2011 | Ford | 494/56 |

FOREIGN PATENT DOCUMENTS

| | | | |
|---|---|---|---|
| JP | 63-115451 | U | 7/1988 |
| JP | 4-330954 | A | 11/1992 |
| JP | 8-159619 | A | 6/1996 |
| JP | 10-009722 | A | 1/1998 |
| JP | 2001-121036 | A | 5/2001 |
| JP | 2002-276328 | A | 9/2002 |
| JP | 2003-83272 | A | 3/2003 |
| JP | 2004-052710 | A | 2/2004 |
| JP | 2006-21070 | A | 1/2006 |
| JP | 2008-101831 | A | 5/2008 |
| JP | 2008-151476 | A | 7/2008 |
| JP | 2008-196721 | A | 8/2008 |
| JP | 2009-257115 | A | 11/2009 |
| JP | 2010-101613 | A | 5/2010 |
| KR | 10-2010-0003871 | A | 1/2010 |

OTHER PUBLICATIONS

Korean Notice of Allowance dated Aug. 22, 2014, issued in Korean Application No. 10-2012-7027964; w/English translation.(4 pages).

Chinese Office Action dated Jul. 28, 2014, issued in corresponding Chinese Patent Application No. 201180020719.6, w/English translation (15 pages).

Japanese Office Action dated Aug. 19, 2014, issued in Japanese Patent Application No. 2010-222505, w/English translation (8 pages).

* cited by examiner

OIL SEPARATION MEANS AND REFRIGERATION DEVICE EQUIPPED WITH THE SAME

TECHNICAL FIELD

The present invention relates to oil separation means and a refrigeration device equipped with the same, and more particularly, to cyclone-type oil separation means.

BACKGROUND ART

Compressors provided in turbo refrigerators employ the forced-circulation method in which lubricating oil is forcedly supplied by a lubricating oil pump from a lubricating oil tank to a gear and bearing that drive the compressor. Because of this, due to a pressure difference (oil-supply differential pressure) between the pressure at the outlet of the lubricating oil pump and the pressure inside the lubricating oil tank during operation of the turbo refrigerator, some of the lubricating oil inside the lubricating oil tank is sucked into the compressor, causing the level of lubricating oil in the lubricating oil tank to drop.

When the level of lubricating oil in the lubricating oil tank drops in this way, the oil supply differential pressure between the pressure at the outlet of the lubricating oil pump and the pressure inside the lubricating oil tank ends up being reduced, and there is a risk of damage to the compressor. Because the lubricating oil sucked in by the compressor is guided to a condenser together with refrigerant, the lubricating oil adheres to a heat exchanger portion in the condenser, causing a reduction in heat transfer.

A method for recovering the lubricating oil sucked into the compressor and mixed with the refrigerant involves using a shell-and-tube condenser and recovering the lubricating oil as drainage, and providing an oil mist separator tank at a discharge side of the compressor for performing separation and recovery of the lubricating oil that is mixed with the refrigerant.

Patent Literature 1 and Patent Literature 4 disclose inventions directed to cyclone-type oil mist separators, and Patent Literature 2 and Patent Literature 3 disclose inventions directed to demister-type oil mist separators.

Patent Literature 5 discloses making finer droplets of lubricating oil by using a double-flow nozzle, thereby improving the cooling effect of the refrigerant during the compression process in the compressor with a supply of lubricating oil.

The cyclone-type oil mist separator tank will be described here using FIGS. 3A to 4F.

FIG. 3A is a longitudinal sectional view showing, in outline, the configuration of a cyclone-type oil mist separator tank in the related art, and FIG. 3B is a lateral sectional view showing, in outline, the configuration thereof.

An oil mist separator tank 100 includes a cylindrical tank body 101 and end plates 102 at both ends of the tank body 101. A core 103 passes through along the center axis of the tank body 101. By rotating the oil mist separator tank 100 about this core 103, the lubricating oil that is mixed with the refrigerant is centrifugally separated. An oil collecting demister (not illustrated) is provided at an inner wall of the tank body 101, where the centrifugally separated lubricating oil is trapped so as to be prevented from being redispersed.

A refrigerant inflow pipe 104 through which the refrigerant, mixed with the lubricating oil, flows in is provided in the tank body 101 near one of the end plates 102*a* provided at both ends of the tank body 101, and a refrigerant outflow pipe 105 through which the refrigerant, from which the lubricating oil has been separated, flows out to the outside is provided in the tank body 101 near the other end plate 102*b*. An oil drain hole, which is not illustrated, is provided in the tank body 101 so that the trapped lubricating oil can be discharged.

Tangential velocity vectors inside an oil mist separator tank 100 with such a configuration will be described using FIGS. 4A to 4F.

FIGS. 4A to 4F show tangential velocity vector diagrams inside the oil mist separator tank, where FIG. 4A is a schematic view of the oil mist separator tank shown in FIG. 3A, and FIGS. 4B to 4F show tangential velocity vector diagrams in cross-sections at part F-F to part J-J in FIG. 4A.

The tangential velocity vector diagrams in each of the cross-sections in FIGS. 4B to 4F show cases where the refrigerant that has flowed into the oil mist separator tank 100 from the refrigerant inflow pipe 104 is divided into five parts, from the upstream side to the downstream side, in this order, in the axial direction of the oil mist separator tank 100.

As shown in FIG. 4B, the tangential velocity vectors in the cross-section F-F in the oil mist separator tank 100, on the extension of the center axis of the refrigerant inflow pipe 104, are densely and substantially uniformly distributed so as to point in the extending direction of the center axis of the refrigerant inflow pipe 104, in the space (at the left side in FIG. 4B) formed between the core 103 (see FIG. 3B) and the tank body 101 through which the refrigerant inflow pipe 104 passes.

The oil-containing refrigerant that has flowed into the oil mist separator tank 100 from the refrigerant inflow pipe 104 flows in the direction of the extension line of the center axis of the refrigerant inflow pipe 104 and collides with the inner wall of the tank body 101 which exists in front thereof, causing the flow direction to turn so as to go along the inner wall of the tank body 101. Of the refrigerant whose flow direction has turned, the velocity of the refrigerant along the inner wall of the tank body 101 becomes faster than the velocity of the refrigerant that flows near the outer wall of the core 103, causing swirling. This is shown, in FIG. 4B, by the fact that the velocity vectors near the inner wall of the tank body 101 become denser than the velocity vectors near the outer wall of the core 103.

CITATION LIST

Patent Literature

{PTL 1} Japanese Unexamined Patent Application, Publication No. 2008-101831

{PTL 2} Japanese Unexamined Patent Application, Publication No. 2008-151476

{PTL 3} Japanese Unexamined Patent Application, Publication No. 2008-196721

{PTL 4} Japanese Unexamined Patent Application, Publication No. 2009-257115

{PTL 5} Japanese Unexamined Patent Application, Publication No. 2010-101613

SUMMARY OF INVENTION

Technical Problem

However, with the inventions described in Patent Literature 1 and Patent Literature 4, in the oil mist separator tank 100 in the related art, shown in FIGS. 3A to 4F, part of the flow guided into the oil mist separator tank 100 from the refrigerant inflow pipe 104 moves farther towards the downstream side in the axial direction of the oil mist separator tank 100 than the cross-section F-F in the oil mist separator tank 100 on the extension of the center axis of the refrigerant inflow pipe 104, as shown in FIG. 4C, and therefore, the tangential velocity of the refrigerant decreases. Accordingly, the centrifugal force acting on the swirling oil decreases, causing a problem in that the separation performance is reduced.

The present invention has been conceived in light of such circumstances, and an object thereof is to provide centrifugal-separation oil separation means whose cyclone efficiency can be improved, as well as a refrigeration device equipped with the same.

Solution to Problem

In order to realize the object described above, the present invention provides the following solutions.

Centrifugal-separation oil separation means according to an aspect of the present invention includes an outer cylinder that extends in an axial direction; an inner cylinder that passes through the interior of the outer cylinder in the axial direction; a pair of end plates provided at both ends of the outer cylinder; an inlet port that is connected to the outer cylinder near one of the end plates and that introduces an oil-containing fluid discharged from a compressor into a space formed between the outer cylinder and the inner cylinder so as to swirl about the axis; an outlet port that is connected to the outer cylinder near the other end plate and that expels the fluid, from which the oil has been centrifugally separated, out of the space; and an oil discharge port, provided in the outer cylinder, for discharging the separated oil out of the space, wherein a partition plate that extends over at least part of a cross-section perpendicular to the axial direction to partition the space in the axial direction is provided in the space.

The partition plate, which extends over at least part of the cross-section perpendicular to the axial direction of the outer cylinder so as to partition the space in the axial direction, is provided in the space between the outer cylinder and the inner cylinder of the oil separation means for separating oil that is mixed with the fluid by means of centrifugal separation. By doing so, movement of part of the fluid introduced into the space from the inlet port in the axial direction of the outer cylinder, without swirling, can be inhibited. Therefore, it is possible to promote a swirling flow of the fluid, and thus, the centrifugal force acting on the oil can be increased. Accordingly, the cyclone efficiency can be improved.

Because the cyclone efficiency can be improved by providing the partition plate in the space, the oil separation can be reduced in size compared with the related art.

In the above-described aspect, the partition plate may be provided near the inlet port, in the space, between the inlet port and the outlet port.

The partition plate is provided in the space, between the inlet port and the outlet port, near the inlet port. By doing so, movement of part of the fluid introduced into the space from the inlet port in the axial direction of the outer cylinder, without swirling, can be inhibited. Therefore, it is possible to promote a swirling flow of the fluid, and thus the centrifugal force acting on the oil can be increased. Accordingly, the cyclone efficiency can be improved.

In the above-described aspect, the partition plate may be provided in an area from a connecting end of the inlet port connected to the outer cylinder to a 135° position in the circumferential direction of the swirling fluid.

If the area occupied by the partition plate in the circumferential direction becomes large, the flow path area decreases, causing the pressure loss to increase.

Thus, the partition plate is provided in the area from the connecting end of the outer cylinder and the inlet port up to the 135° position in the circumferential direction of the swirling fluid. By doing so, movement of part of the fluid in the axial direction of the outer cylinder, without swirling, can be inhibited without reducing the flow-path area of the fluid. Therefore, the cyclone efficiency can be improved while suppressing the pressure loss.

The partition plate preferably connects an area from a connecting end in the circumferential direction of the swirling fluid to a position of 30° to 135° in the circumferential direction.

In the above-described aspect, the partition plate may be provided in the form of a ring in the space, near the inlet port, between the one end plate and the inlet port.

The ring-shaped partition plate is provided near the inlet port in the space between the inlet port and the upstream end plate. By doing so, movement of part of the fluid guided into the space from the inlet port towards the upstream end plate, without swirling, can be restricted. Therefore, a swirling flow of the fluid is promoted, and the centrifugal force acting on the oil can be increased. Accordingly, the cyclone efficiency can be improved.

A refrigeration device according to an aspect of the present invention includes any one of the above-described centrifugal-separation oil separation means.

Because the oil separation means, whose cyclone efficiency can be improved, is used, it is possible to suppress the adherence of oil, which circulates inside the refrigeration device together with the refrigerant circulating in the refrigeration device, to a heat exchanger or the like. Therefore, it is possible to prevent a drop in the heat transfer coefficient.

Because the oil separation means, which can be reduced in size while improving the cyclone efficiency, is used, the amount of refrigerant filled in the refrigeration device can be reduced.

Advantageous Effects of Invention

With the centrifugal-separation oil separation means according to the present invention, the partition plate that extends over at least part of the cross-section perpendicular to the axial direction of the outer cylinder is provided in the space between the outer cylinder and the inner cylinder of the oil separation means for separating oil mixed with fluid by means of centrifugal separation. By doing so, the movement of part of the fluid introduced into the space from the inlet port in the axial direction of the outer cylinder, without swirling, can be inhibited. Therefore, it is possible to promote a swirling flow of the fluid, and thus it is possible to increase the centrifugal force acting on the oil. Accordingly, it is possible to improve the cyclone efficiency.

Because the cyclone efficiency can be improved by providing the partition plate in the space, the oil separation means can be reduced in size compared with oil separation means in the related art.

DESCRIPTION OF EMBODIMENTS

An embodiment of the present invention will be described below with reference to FIGS. 1A to 2F.

Figure 1A:
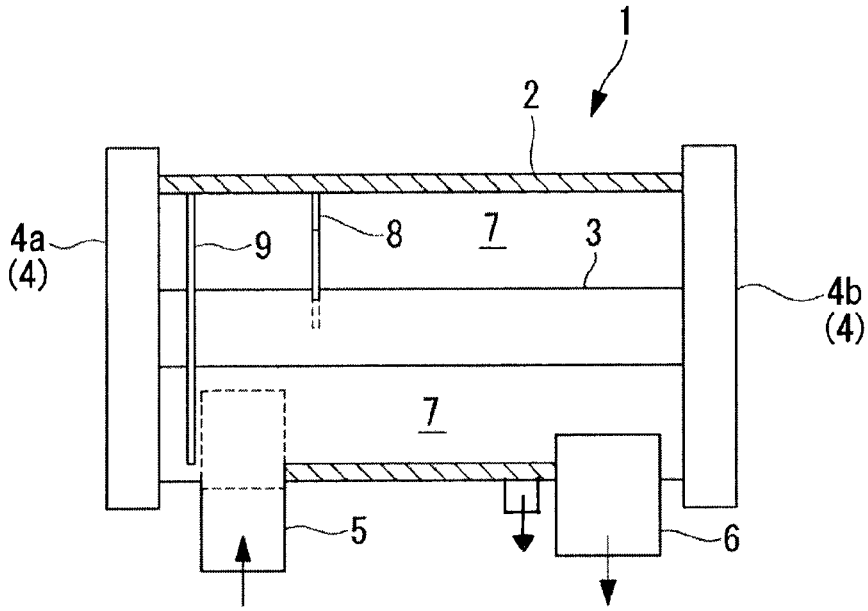
FIG. 1A is a longitudinal sectional view showing, in outline, the configuration of an oil mist separator tank provided in a turbo refrigeration device according to an embodiment of the present invention.
Figure 1B:
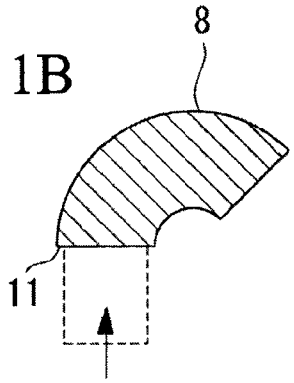
FIG. 1B shows a partition plate of an oil mist separator tank provided in a turbo refrigeration device according to an embodiment of the present invention.
Figure 1C:
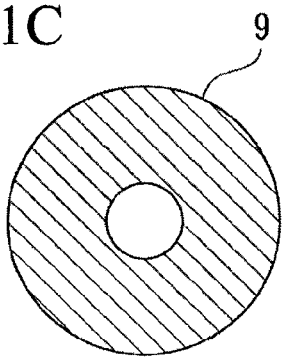
FIG. 1C shows a partition plate of an oil mist separator tank provided in a turbo refrigeration device according to an embodiment of the present invention.

FIGS. 1A and 1B show an oil mist separator tank provided in a turbo refrigeration device according to an embodiment of the present invention, where FIG. 1A is a longitudinal sectional view showing, in outline, the configuration thereof, and FIGS. 1B and 1C show partition plates.

An oil mist separator tank (oil separation means) 1 is assumed to be of the horizontal type. The oil mist separator tank 1 includes an outer cylinder 2 the inner diameter of which extends by, for example, 600 mm in the axial direction; an inner cylinder 3 that passes through the interior of the outer cylinder 2 in the axial direction; a pair of end plates 4 provided at both ends of the outer cylinder 2; an inlet port 5 connected with the outer cylinder 2 near one end plate 4*a* (the left side in FIG. 1A) for introducing oil-containing refrigerant (fluid) that is discharged from a compressor (not shown in the drawings) into a space 7 formed between the outer cylinder 2 and the inner cylinder 3 so as to swirl around the axis thereof; an outlet port 6 connected to the outer cylinder 2 near the other end plate 4*b* (the right side in FIG. 1A) for expelling the refrigerant, from which the oil has been centrifugally separated, out of the space 7; and an oil discharge port (not shown in the drawings) for discharging the separated oil from the space 7.

The inlet port 5 is connected so as to be perpendicular to the axial direction of the outer cylinder 2. Therefore, the refrigerant that is guided into the oil mist separator tank 1 through the outlet port 6 exhibits a swirling flow about the axis of the outer cylinder 2, along the space 7, which is formed in an annular shape. A cyclone effect (centrifugal separation effect) is generated in the refrigerant by means of this swirling flow.

In addition, the inlet port 5 is provided near the end plate 4*a* located on the upstream side in the axial direction of the outer cylinder 2. By doing so, the distance over which the swirling flow generated in the refrigerant moves inside the oil mist separator tank 1 is lengthened. This distance is assumed to be a distance sufficiently long to exhibit the cyclone effect that separates the oil contained in the refrigerant.

The outlet port 6, which is at the downstream side in the axial direction of the outer cylinder 2, is provided so as to be perpendicular to the axial direction of the outer cylinder 2. Connecting the outlet port 6 to the outer cylinder 2 in this way makes it easier for the flow of refrigerant that has swirled inside the oil mist separator tank 1 to be expelled outside the oil mist separator tank 1.

The space 7 is formed between the inner wall of the outer cylinder 2 and the outer wall of the inner cylinder 3. The refrigerant moves in a swirling fashion through this space 7 from the upstream side to the downstream side in the axial direction of the outer cylinder 2. Due to this swirling flow, a centrifugal force acts on the oil in the refrigerant, causing the oil to be separated from the refrigerant.

An oil-collecting demister, which is not illustrated, is provided at the inner wall of the outer cylinder 2. The oil-collecting demister, which is made of metal, prevents the oil that has been separated from the refrigerant from being redispersed. The oil collected in the oil-collecting demister moves in the direction of the gravitational force (downward in FIG. 1A) and is discharged outside the oil mist separator tank 1 from the oil discharge port provided in the outer cylinder 2.

As shown in FIG. 1A, an upstream-portion partition plate (first partition plate) 8 that extends over at least part of the cross-section perpendicular to the axial direction of the outer cylinder 2 so as to partition the space 7 in the axial direction is provided in the space 7 between the inlet port 5 and the outlet port 6, near the inlet port 5.

As shown in FIG. 1B, the first partition plate 8 takes a sector-shaped form that connects the area between a connection end 11 of the inlet port 5 connected to the outer cylinder 2 and a 135° position in the circumferential direction of the swirling refrigerant.

The first partition plate 8 preferably connects the area from the connection end 11 to at least a position of 30° or greater up to 135° in the circumferential direction of the swirling refrigerant.

An annular partition plate (second partition plate) 9 that has an annular form that extends over the entire cross-section perpendicular to the axial direction of the outer cylinder 2 so as to partition the space 7 in the axial direction is provided in the space 7 near the inlet port 5, between the upstream (one) end plate 4*a* and the inlet port 5.

A downstream-portion partition plate (not shown in the drawings) that extends over at least part of the cross-section perpendicular to the axial direction of the outer cylinder 2 so as to partition the space 7 in the axial direction is provided in the space 7 between the inlet port 5 and the outlet port 6, near the outlet port 6.

The downstream-portion partition plate takes a sector-shaped form that connects the area from position 12 (see FIG. 2), where the center axis of the outlet port 6 connected to the outer cylinder 2 intersects the outer cylinder 2, up to the 135° position in the anticlockwise circumferential direction.

Next, the flow in which the oil is separated from the refrigerant and the flow of refrigerant inside the oil mist separator tank 1 will be described using FIGS. 1A to 2F.

Figure 2A:
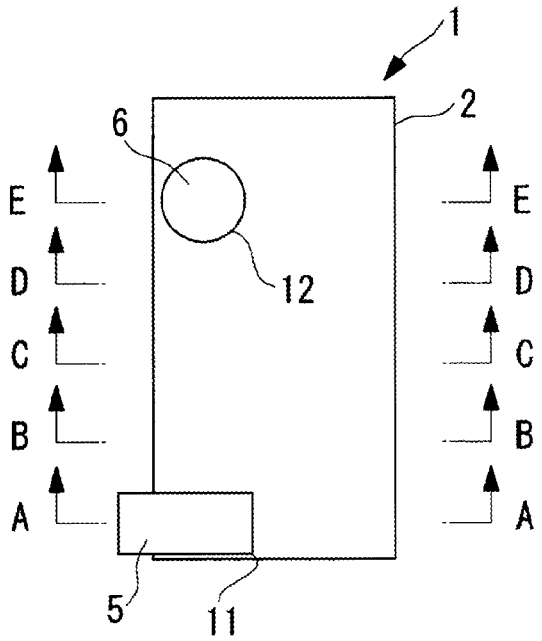
FIG. 2A is a schematic diagram of the oil mist separator tank shown in FIG. 1A
Figure 2B:
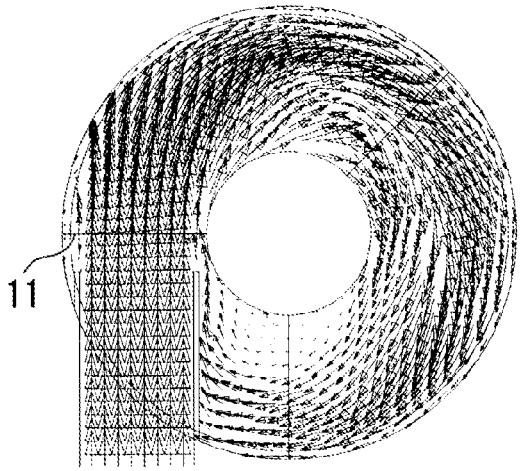
FIG. 2B is a tangential velocity vector diagram of the inside of the oil mist separator tank shown in FIGS. 1A to 1C, showing a cross-section along part A-A in FIG. 2A.
Figure 2C:
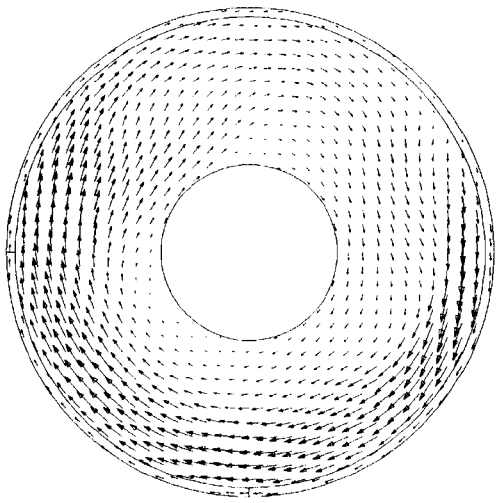
FIG. 2C is a tangential velocity vector diagram of the inside of the oil mist separator tank shown in FIGS. 1A to 1C, showing a cross-section along part B-B in FIG. 2A.
Figure 2D:
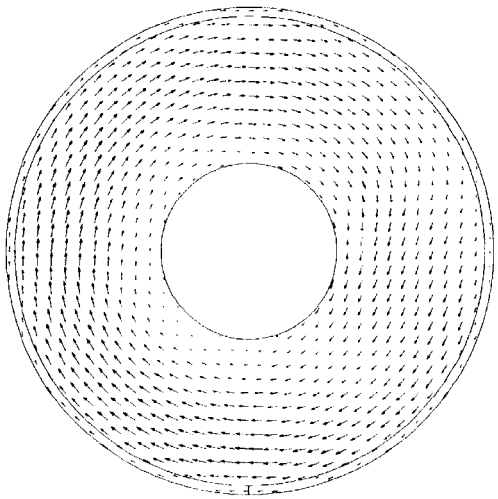
FIG. 2D is a tangential velocity vector diagram of the inside of the oil mist separator tank shown in FIGS. 1A to 1C, showing a cross-section along part C-C in FIG. 2A.
Figure 2E:
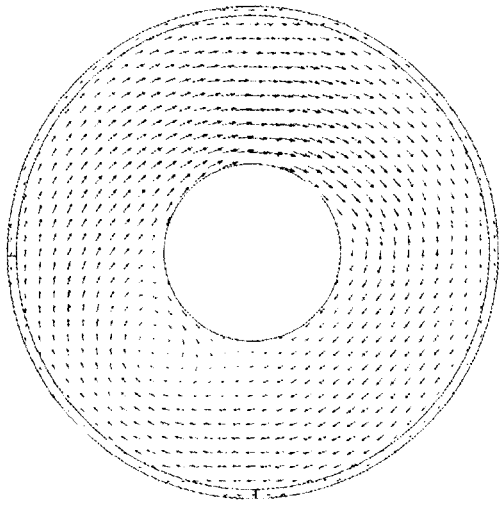
FIG. 2E is a tangential velocity vector diagram of the inside of the oil mist separator tank shown in FIGS. 1A to 1C, showing a cross-section along part D-D in FIG. 2A.

Because a portion of the cross-section perpendicular to the axial direction of the space 7 is partitioned by the first partition plate 8, and the entirety of the cross-section perpendicular to the axial direction of the space 7, from the inlet port 5 to the end plate 4*a* at the upstream end, is partitioned by the second partition plate 9, for the oil-containing refrigerant that has flowed into the space 7 from the compressor via the inlet port 5, as shown in FIG. 2B and FIG. 2C, the movement of the refrigerant that tends to move downstream in the axial direction of the outer cylinder 2 and the movement of the refrigerant that tends to move from the inlet port 5 towards the end plate 4*a* are restricted.

By providing the first partition plate 8 and the second partition plate 9 in this way, the amount of the portion of the refrigerant in the cross-section A-A shown in FIG. 2A that moves towards the downstream side and the upstream side in the axial direction of the outer cylinder 2 can be restricted to about 40% compared with the related art. Therefore, a swirling flow of refrigerant develops in the cross-section A-A, increasing the centrifugal force exerted on the oil contained in the refrigerant, and therefore, it is possible to improve the cyclone efficiency for separating the oil from the refrigerant (centrifugal separation efficiency).

Figure 2F:
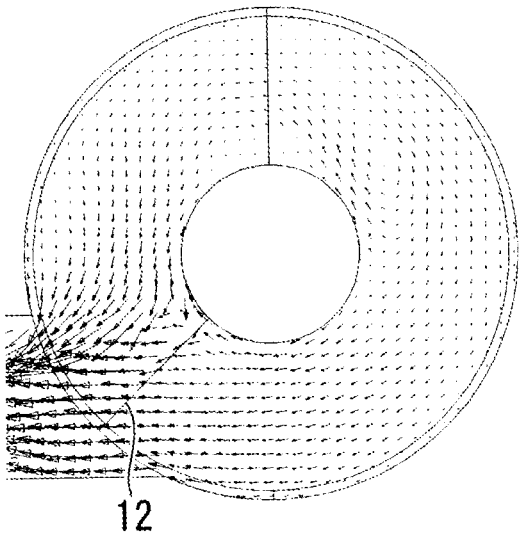
FIG. 2F is a tangential velocity vector diagram of the inside of the oil mist separator tank shown in FIGS. 1A to 1C, showing a cross-section along part E-E in FIG. 2A.
Figure 3A:
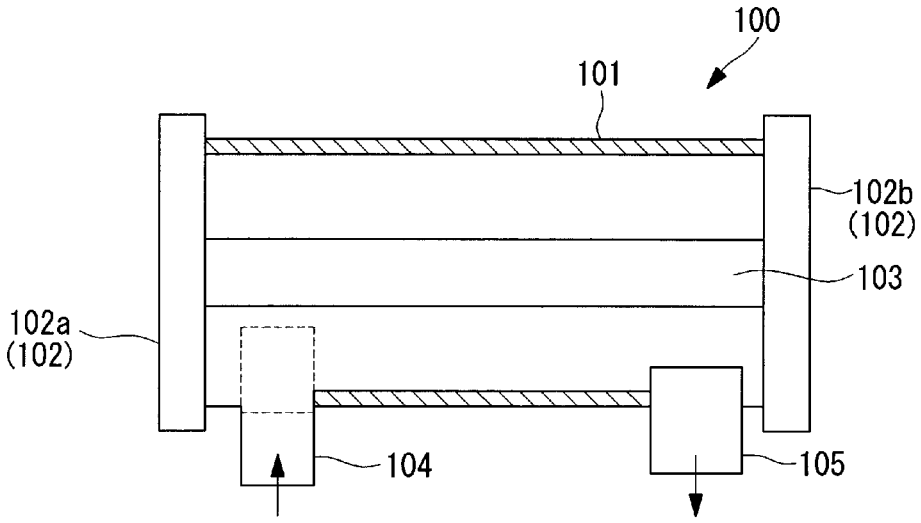
FIG. 3A is a longitudinal sectional view showing, in outline, the configuration of an oil mist separator tank in the related art.
Figure 3B:
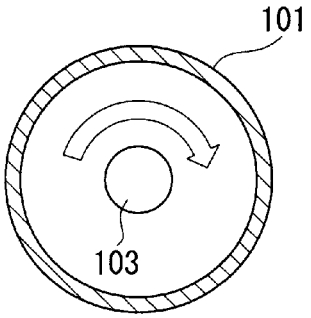
FIG. 3B is a lateral sectional view showing, in outline, the configuration of the oil mist separator tank in the related art.
Figure 4A:
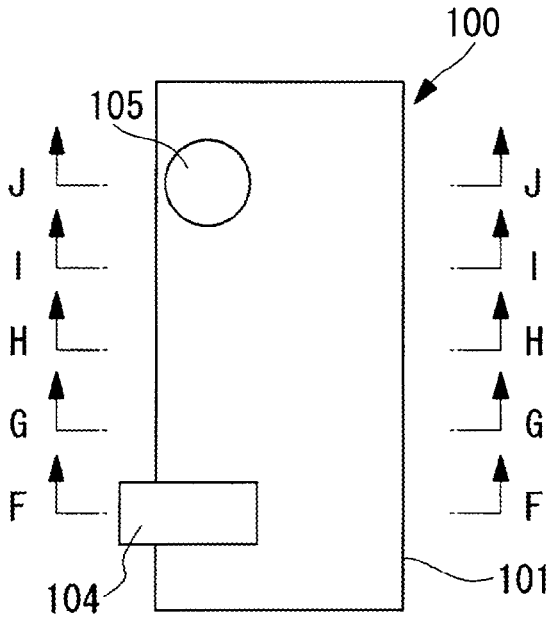
FIG. 4A is a schematic diagram of the oil mist separator tank shown in FIG. 3A.
Figure 4B:
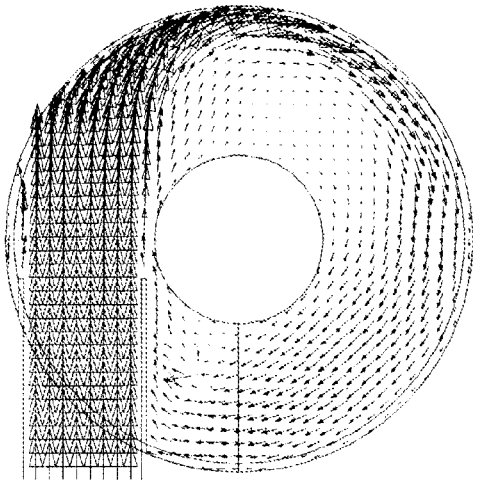
FIG. 4B is a tangential velocity vector diagram of the inside of the oil mist separator tank shown in FIGS. 3A and 3B, showing a cross-section along part F-F in FIG. 4A.
Figure 4C:
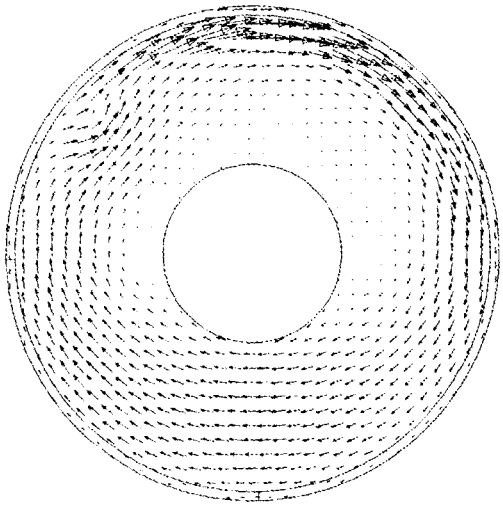
FIG. 4C is a tangential velocity vector diagram of the inside of the oil mist separator tank shown in FIGS. 3A and 3B, showing a cross-section along part G-G in FIG. 4A.
Figure 4D:
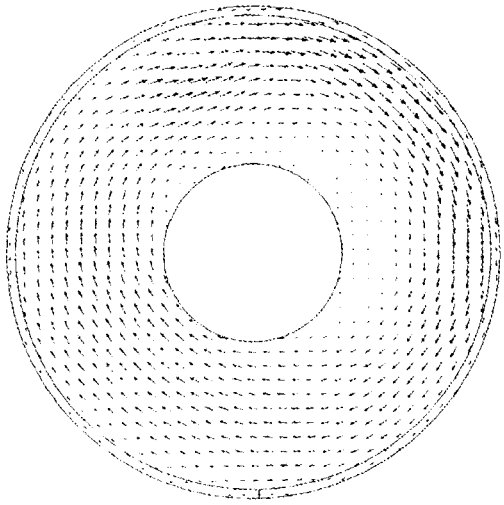
FIG. 4D is a tangential velocity vector diagram of the inside of the oil mist separator tank shown in FIGS. 3A and 3B, showing a cross-section along part H-H in FIG. 4A.
Figure 4E:
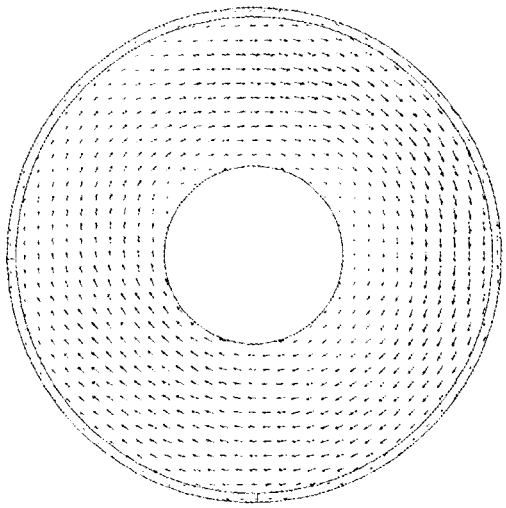
FIG. 4E is a tangential velocity vector diagram of the inside of the oil mist separator tank shown in FIGS. 3A and 3B, showing a cross-section along part I-I in FIG. 4A.
Figure 4F:
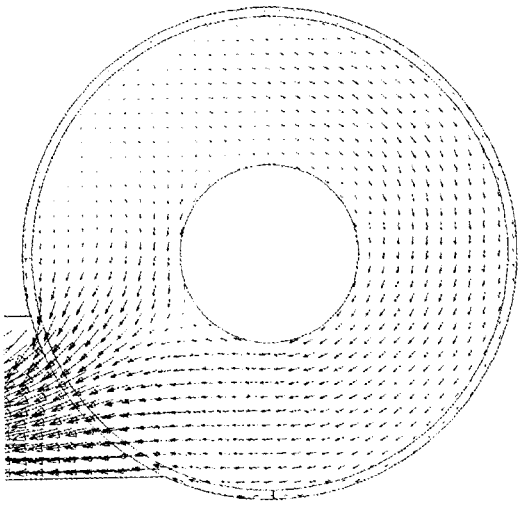
FIG. 4F is a tangential velocity vector diagram of the inside of the oil mist separator tank shown in FIGS. 3A and 3B, showing a cross-section along part J-J in FIG. 4A.

By providing the downstream-portion partition plate, as shown in FIG. 2F, the refrigerant flowing in the opposite direction to the swirling direction of the refrigerant in the cross-section E-E shown in FIG. 2A is inhibited from moving towards the outlet port 6. Thus, it is possible to promote a swirling flow of the refrigerant and to improve the cyclone efficiency.

With the centrifugal-separation oil mist separator tank 1 according to the embodiment described above and the turbo refrigeration device equipped with the same, the following advantages are afforded.

The first partition plate 8, the second partition plate 9, and the downstream-portion partition plate, which extend over at least part of the cross-section perpendicular to the axial direction of the outer cylinder 2 so as to partition the space 7 in the axial direction, are provided in the space 7 between the outer cylinder 2 and the inner cylinder 3 of the oil mist separator tank (oil separation means) 1 for separating oil that is mixed with the refrigerant (fluid) by means of centrifugal separation. By doing so, movement of part of the refrigerant introduced into the space 7 from the inlet port 5 in the axial direction of the outer cylinder 2, without swirling, can be inhibited. Therefore, it is possible to promote a swirling flow of the refrigerant, and thus, the centrifugal force acting on the oil can be increased. Accordingly, the cyclone efficiency can be improved.

Because the cyclone efficiency can be improved by providing the first partition plate 8, the second partition plate 9, and the downstream-portion partition plate in the space 7, the oil mist separator tank 1 can be reduced in size.

The first partition plate 8 is provided in the space 7, between the inlet port 5 and the outlet port 6, near the inlet port 5. By doing so, movement of part of the refrigerant introduced into the space 7 from the inlet port 5 to the downstream side in the axial direction of the outer cylinder 2, without swirling, can be inhibited. Therefore, it is possible to promote a swirling flow of the refrigerant, and thus the centrifugal force acting on the oil can be increased. Accordingly, the cyclone efficiency can be improved.

The first partition plate 8 is provided in the area from the connecting end 11 of the outer cylinder 2 and the inlet port 5 up to the 135° position in the circumferential direction of the swirling refrigerant. By doing so, movement of part of the refrigerant downstream in the axial direction of the outer cylinder 2, without swirling, can be inhibited without reducing the flow-path area of the refrigerant in the cross-section A-A (see FIG. 2A). Therefore, the cyclone efficiency can be improved while suppressing the pressure loss.

The ring-shaped second partition plate 9 is provided near the inlet port 5 in the space 7 between the inlet port 5 and the upstream (one) end plate 4*a*. By doing so, movement of part of the refrigerant guided into the space 7 from the inlet port 5 towards the upstream end plate 4*a*, without swirling, can be restricted. Therefore, a swirling flow of the refrigerant is promoted, and the centrifugal force acting on the oil can be increased. Accordingly, the cyclone efficiency can be improved.

The oil mist separator tank 1, whose cyclone efficiency can be improved, is used. By doing so, it is possible to suppress the adherence of oil, which circulates inside the refrigeration device together with the refrigerant circulating in the refrigeration device (not illustrated), to the heat exchanger (not illustrated) or the like. Therefore, it is possible to prevent a drop in the heat transfer coefficient.

Because the oil mist separator tank 1, which can be reduced in size while improving the cyclone efficiency, is used, the amount of refrigerant filled in the refrigeration device can be reduced.

In this embodiment, a description has been given assuming that the oil mist separator tank 1 is of the horizontal type; however, the present invention is not limited to this and is also applicable to a vertical type.

REFERENCE SIGNS LIST

1 oil mist separator tank (oil separation means)
2 outer cylinder
3 inner cylinder
4, 4*a*, 4*b* end plate
5 inlet port
6 outlet port
7 space
8 first partition plate
9 second partition plate

The invention claimed is:

1. A centrifugal-separation oil separation means comprising:

an outer cylinder that extends in a direction of an axis;

an inner cylinder that passes through the interior of the outer cylinder in the direction of the axis;

a pair of end plates provided at both ends of the outer cylinder;

an inlet port that is connected to the outer cylinder near one of the end plates and that introduces an oil-containing fluid discharged from a compressor into a space formed between the outer cylinder and the inner cylinder so as to swirl about the axis;

an outlet port that is connected to the outer cylinder near the other end plate and that expels the fluid, from which the oil has been centrifugally separated, out of the space; and an oil discharge port, provided in the outer cylinder, for discharging the separated oil out of the space, wherein the entire inner cylinder is provided within the interior of the outer cylinder in the direction of the axis, wherein both ends of the inner cylinder reach the end plates, a partition plate that extends over at least part of a cross-section perpendicular to the direction of the axis to partition the space in the direction of the axis is provided in the space, and wherein the partition plate comprises a first partition plate that is a member cut away from a ring-shaped member, said first partition plate having an angular range between 30° and 135°, and a second partition plate that is provided in the form of a ring in the space, near the inlet port, between the one of the end plates and the inlet port, and wherein the first partition plate is provided in an area from a connecting end of the inlet port connected to the outer cylinder to the circumferential direction of the swirling fluid.

2. The centrifugal-separation oil separation means according to claim 1, wherein the first partition plate is provided near the inlet port, in the space, between the inlet port and the outlet port.

3. A refrigeration device comprising the centrifugal-separation oil separation means according to claim 1.

* * * * *